US012297586B2

(12) United States Patent
Shin et al.

(10) Patent No.: US 12,297,586 B2
(45) **Date of Patent: *May 13, 2025**

(54) DRYER

(71) Applicant: LG Electronics Inc., Seoul (KR)

(72) Inventors: Woosup Shin, Seoul (KR); Sungmin Ye, Seoul (KR); Chanwoo Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 658 days.

This patent is subject to a terminal disclaimer.

(21) Appl. No.: 17/624,712

(22) PCT Filed: Jul. 3, 2020

(86) PCT No.: PCT/KR2020/008707

§ 371 (c)(1),
(2) Date: Jan. 4, 2022

(87) PCT Pub. No.: WO2021/002721

PCT Pub. Date: Jan. 7, 2021

(65) Prior Publication Data

US 2022/0259795 A1 Aug. 18, 2022

(30) Foreign Application Priority Data

Jul. 4, 2019 (KR) ..... 10-2019-0080602

(51) Int. Cl.
*D06F 58/26* (2006.01)
*D06F 34/10* (2020.01)
(Continued)

(52) U.S. Cl.
CPC ..... *D06F 58/26* (2013.01); *D06F 34/10* (2020.02); *D06F 34/14* (2020.02); *D06F 58/04* (2013.01);
(Continued)

(58) Field of Classification Search
None
See application file for complete search history.

(56) References Cited

U.S. PATENT DOCUMENTS 5,463,821 A 11/1995 Gauer
11,939,719 B2 * 3/2024 Kim ..... D06F 34/10
(Continued)

FOREIGN PATENT DOCUMENTS

JP H08-24494 1/1996
JP 2006-149435 6/2006
(Continued)

OTHER PUBLICATIONS

Office Action in Korean Appln. No. 10-2019-0080602, mailed on Jun. 14, 2024, 9 pages (with English translation).
(Continued)

*Primary Examiner* — David J Laux
(74) *Attorney, Agent, or Firm* — Fish & Richardson P.C.

(57) ABSTRACT

The present disclosure relates to a dryer. A dryer according to an embodiment of the present disclosure includes a drum, at least one lifter formed to protrude from an inner peripheral surface of the drum, an anode disposed in the lifter to output a RF signal, and a RF output device configured to output the RF signal. Therefore, it is possible to uniformly dry laundry in the drum.

17 Claims, 22 Drawing Sheets

(51) Int. Cl.

| | |
|---|---|
| ***D06F 34/14*** | (2020.01) |
| ***D06F 58/04*** | (2006.01) |
| ***D06F 58/38*** | (2020.01) |
| ***D06F 103/64*** | (2020.01) |
| ***D06F 105/14*** | (2020.01) |

(52) U.S. Cl.
CPC ..... *D06F 58/38* (2020.02); *D06F 2103/64* (2020.02); *D06F 2105/14* (2020.02)

(56) References Cited

U.S. PATENT DOCUMENTS

| | | | | |
|---|---|---|---|---|
| 2011/0036556 | A1* | 2/2011 | Bison | D06F 58/48 62/238.7 |
| 2011/0241700 | A1* | 10/2011 | Ivanov | G01D 5/24 34/524 |
| 2014/0325865 | A1 | 11/2014 | Wisherd et al. | |
| 2015/0101207 | A1 | 4/2015 | Herman et al. | |
| 2017/0159231 | A1 | 6/2017 | Herman et al. | |

FOREIGN PATENT DOCUMENTS

| | | |
|---|---|---|
| KR | 10-2005-0058742 | 6/2005 |
| KR | 10-2011-0013016 A | 2/2011 |
| KR | 10-2012-0070763 | 7/2012 |
| KR | 10-2013-0044764 A | 5/2013 |

OTHER PUBLICATIONS

International Search Report and Written Opinion in Appln. No. PCT/KR2020/008707, mailed on Nov. 2, 2020, 9 pages (with English translation).

Extended European Search Report in European Appln. No. 20834308.7, mailed on Jun. 27, 2023, 7 pages.

Notice of Allowance in Korean Appln. No. 10-2019-0080602, mailed on Nov. 30, 2024, 3 pages (with English translation).

* cited by examiner

DRYER

CROSS-REFERENCE TO RELATED APPLICATIONS

This application is a National Stage application under 35 U.S.C. § 371 of International Application No. PCT/KR2020/008707, filed on Jul. 3, 2020, which claims the benefit of Korean Patent Application No. 10-2019-0080602, filed on Jul. 4, 2019. The disclosures of the prior applications are incorporated by reference in their entirety.

BACKGROUND OF THE DISCLOSURE

1. Field of the Disclosure

The present disclosure relates to a dryer, and more particularly, to a dryer capable of uniformly drying laundry using an RF signal.

2. Related Art

A dryer is a device which is operated to dry laundry.

For a drying operation, the drying of the laundry can be performed by a method of rotating a drum in the dryer, a method of using a heater and a fan in the dryer, and the like.

However, the method of rotating the drum, the method of using the heater and the fan in the dryer, and the like have a disadvantage of causing damage such as abrasion and shrinkage of the laundry.

Accordingly, research to dry the laundry while reducing the damage to the laundry has been continued.

Meanwhile, according to US Patent Publication No. US2016/01307437, a method of drying laundry using an RF signal is disclosed.

This method has the disadvantage that, in a drum in a dryer, an anode and a cathode are intersected and formed like teeth, and thus, non-uniform drying of the laundry occurs due to the formation of a narrow electric field.

SUMMARY

The present disclosure provides a dryer capable of uniformly drying laundry using an RF signal.

The present disclosure also provides a dryer capable of shortening a drying time during laundry drying using an RF signal.

The present disclosure also provides a dryer capable of reducing arc generation while drying laundry using an RF signal.

According to an aspect of the present disclosure, there is provided a dryer including: a drum; at least one lifter formed to protrude from an inner peripheral surface of the drum; an anode disposed in the lifter to output a RF signal; and a RF output device configured to output the RF signal.

The lifter may include a lifter inner and a lifter outer, and the anode may be disposed between the lifter inner and the lifter.

A first lifter and a second lifter may be disposed to be spaced apart from each other, and a first anode in the first lifter and a second anode in the second lifter may be electrically connected to each other by a connection electrode outside the drum.

The anode may include a first electrode and a second electrode spaced apart from each other, and a third electrode connected between the first electrode and the second electrode.

The dryer may further include a bracket configured to connect the third electrode and the connection electrode outside the drum to each other.

The bracket may include polytetrafluoroethylene.

An angle between an end of the first lifter and an extension line of an end of the second lifter may be 90□ to 110□.

The anode may include aluminum.

A height of the lifter inner may be larger than a height of the anode.

The lifter inner and the lifter outer may include polypropylene (PP).

A first opening and a second opening may be formed in the drum, the first lifter may be coupled and protruded through the first opening, and the second lifter may be coupled and protruded through the second opening.

The dryer may further include a ground electrode connected to an outer peripheral surface of the drum.

An air inlet may be formed in a lower region of the drum.

The dryer may further include a controller configured to control the RF output device, in which the controller may be configured to output a RF signal of first power during a scan section and output a RF signal of second power having a higher level than the first power during a heating section based on a RF signal reflected in response to the RF signal of the first power during the scan section.

The controller may be configured to change the power of the output RF signal according to the reflected signal during the scan section.

Effects of the Disclosure

The dryer according to an embodiment of the present disclosure includes the drum, at least one lifter formed to protrude from the inner peripheral surface of the drum, the anode disposed in the lifter to output the RF signal, and the RF output device configured to output the RF signal. Accordingly, it is possible to uniformly dry laundry in the drum. In particular, since the inside of the drum does not need to be curved to from the lifter, uniform drying of laundry disposed between the lifters is possible. Meanwhile, it is possible to shorten a drying time during the laundry drying by using the RF signal.

The lifter includes the lifter inner and the lifter outer, and the anode is disposed between the lifter inner and the lifter. Accordingly, it is possible to stably insulate the anode and the drum. In addition, it is possible to reduce arc generation.

Meanwhile, the first lifter and the second lifter are disposed to be spaced apart from each other, and the first anode in the first lifter and the second anode in the second lifter are electrically connected to each other by the connection electrode outside the drum. Accordingly, it is possible to output an RF signal from the first anode and the second anode through the connection electrode.

The anode includes the first electrode and the second electrode spaced apart from each other, and the third electrode connected between the first electrode and the second electrode. Accordingly, it is possible to simply connect the third electrode and the connection electrode to each other.

The dryer further includes the bracket configured to connect the third electrode and the connection electrode outside the drum to each other. Accordingly, it is possible to stably connect the third electrode and the connection electrode to each other.

The bracket includes polytetrafluoroethylene. Accordingly, it is possible to reduce RF parasitic capacitance and arc generation.

An angle between the end of the first lifter and the extension line of the end of the second lifter is 90□ to 110□. Accordingly, it is possible to perform heating and drying with maximum efficiency for the laundry between the first lifter and the second lifter.

The anode includes aluminum. Accordingly, it is possible to improve electrical conductivity of the anode.

The height of the lifter inner is larger than the height of the anode. Accordingly, it is possible to protect the anode while protruding the anode. Moreover, it is possible to reduce arc generation.

The lifter inner and the lifter outer include polypropylene (PP). Accordingly, it is possible to reduce an efficiency loss due to the parasitic capacitance.

Meanwhile, the first opening and the second opening are formed in the drum, the first lifter is coupled and protruded through the first opening, and the second lifter is coupled and protruded through the second opening. Accordingly, the first lifter and the second lifter are stably disposed.

Meanwhile, the dryer further includes a ground electrode connected to the outer peripheral surface of the drum. Accordingly, it is possible to perform ground connection to the drum acting as a cathode.

Meanwhile, the air inlet is formed in the lower region of the drum. Accordingly, an air flow inside the drum is formed in a direction of the laundry between the lifters, and drying performance of the laundry is improved.

The dryer further includes a controller configured to control the RF output device, in which the controller is configured to output the RF signal of the first power during the scan section and output the RF signal of the second power having a higher level than the first power during the heating section based on the RF signal reflected in response to the RF signal of the first power during the scan section. Accordingly, it is possible to reduce power consumption while drying the laundry using the RF signal.

The controller is configured to change the power of the output RF signal based on the reflected signal during the scan section. Accordingly, it is possible to reduce the power consumption while drying the laundry using the RF signal.

DESCRIPTION OF EXEMPLARY EMBODIMENTS

Hereinafter, the present disclosure will be described in more detail with reference to the drawings.

Suffixes "module" and "portion" for the components used in the following description are given simply in consideration of ease of describing the present specification, and do not impart a particularly important meaning or role by themselves. Accordingly, the terms "module" and "portion" may be used interchangeably.

Figure 1A:
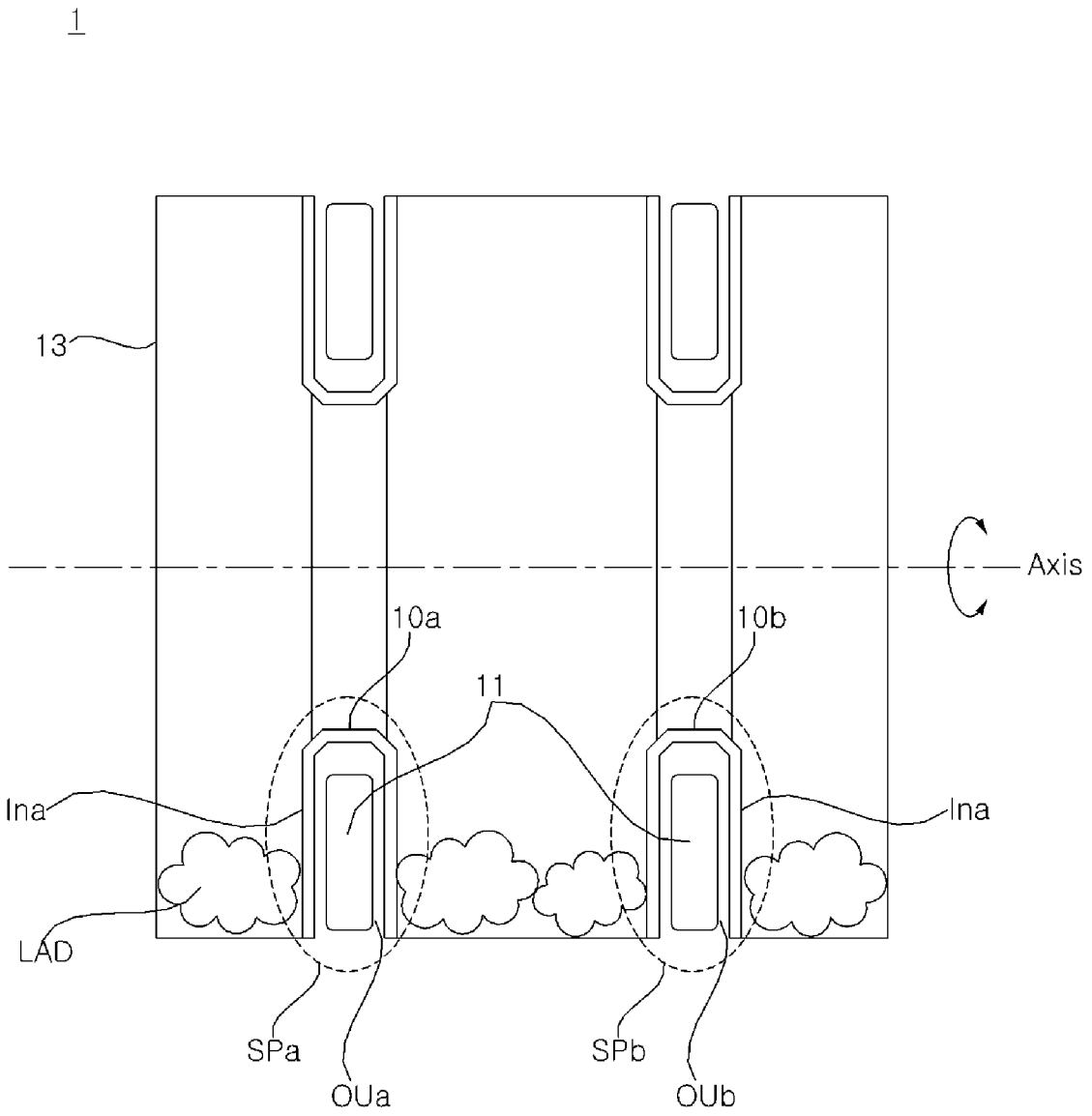
FIGS. 1A to 1C are views illustrating an example of a conventional dryer.
Figure 1B:
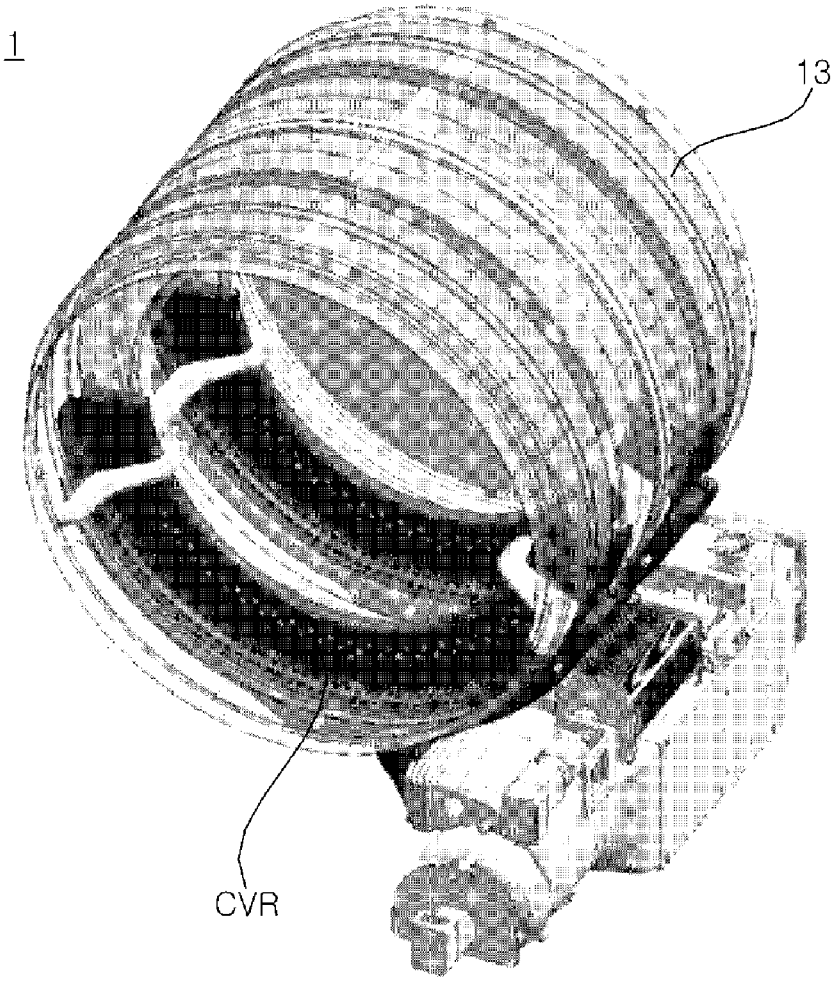
Figure 1C:
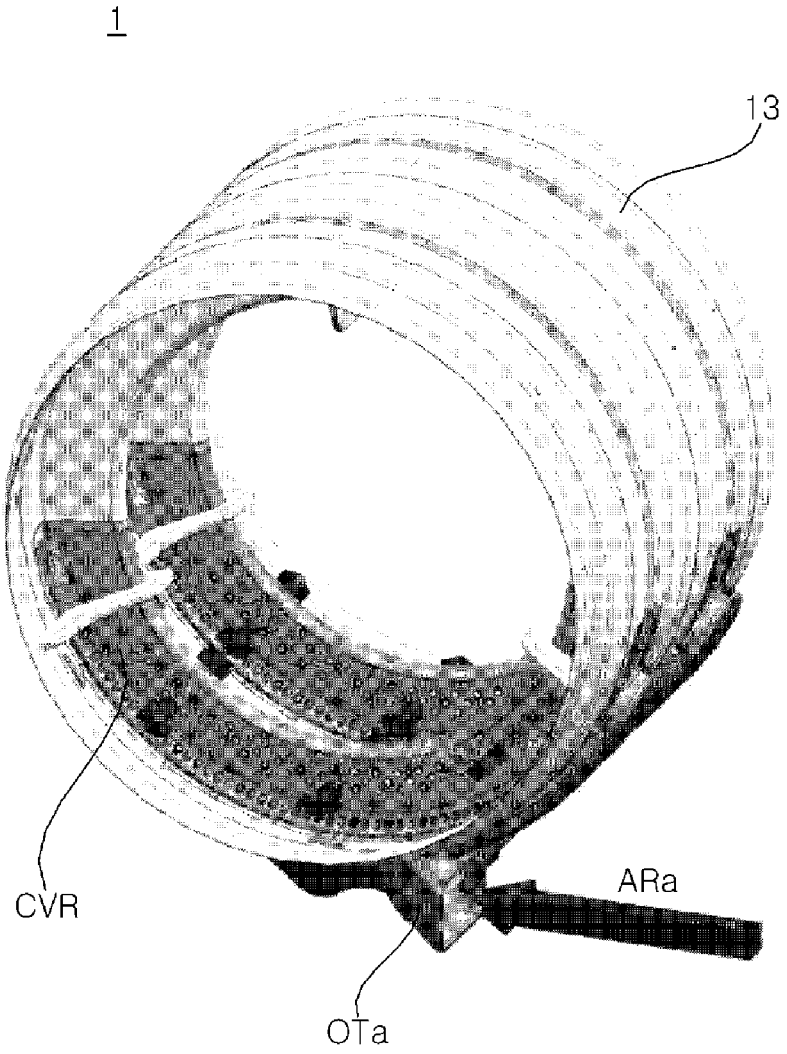

FIGS. 1A to 1C are views illustrating an example of a conventional dryer.

FIG. 1A is a cross-sectional view of the dryer, and FIGS. 1B and 1C are perspective views of the dryer of FIG. 1A.

Referring to the drawings, the conventional dryer 1 includes a cylindrical drum 13, insulating notches 10*a* and 10*b* which recess a portion of the drum 13 to form inner surfaces Ina and Inb of recessed spaces Spa and Spb, and anodes 11 which are disposed on outsides Oua and Oub of the recessed spaces Spa and Spb.

Meanwhile, the drum 13 operates as a cathode.

Accordingly, an RF signal is emitted to the drum 13 by an electric field formed between the anode 11 and the drum 13 or the cathode. Therefore, it is possible to dry wet laundry LAD inside the drum 13 based on the RF signal.

Meanwhile, FIG. 1B illustrates that an anode cover CVR is formed on the insulating notches 10*a* and 10*b*. Due to the output of the RF signal, the cover CVR cannot be formed of a plastic material but should be formed of a metal material.

In particular, it is preferable that the drum 13 and the anode cover CVR are integrally formed. However, in a manufacturing process, it may be difficult to integrally form the drum 13 and the anode cover CVR made of a metal material.

Meanwhile, the insulating notches 10*a* and 10*b* formed on the inner surfaces Ina and Inb of the recessed spaces Spa and Spb have a high possibility of breakage, and a manufacturing process thereof may be difficult.

FIG. 1C illustrates an air outlet OTa formed in the lower portion of the drum 13.

For example, when the laundry LAD is located on the air outlet OTa and covers the air outlet OTa, air in the drum 13 is not smoothly discharged, and thus, a problem in which an internal temperature increases may occur.

Moreover, due to the air outlet OTa formed in the lower portion of the drum 13, a time required to dry the laundry LAD may increase.

Figure 1D:
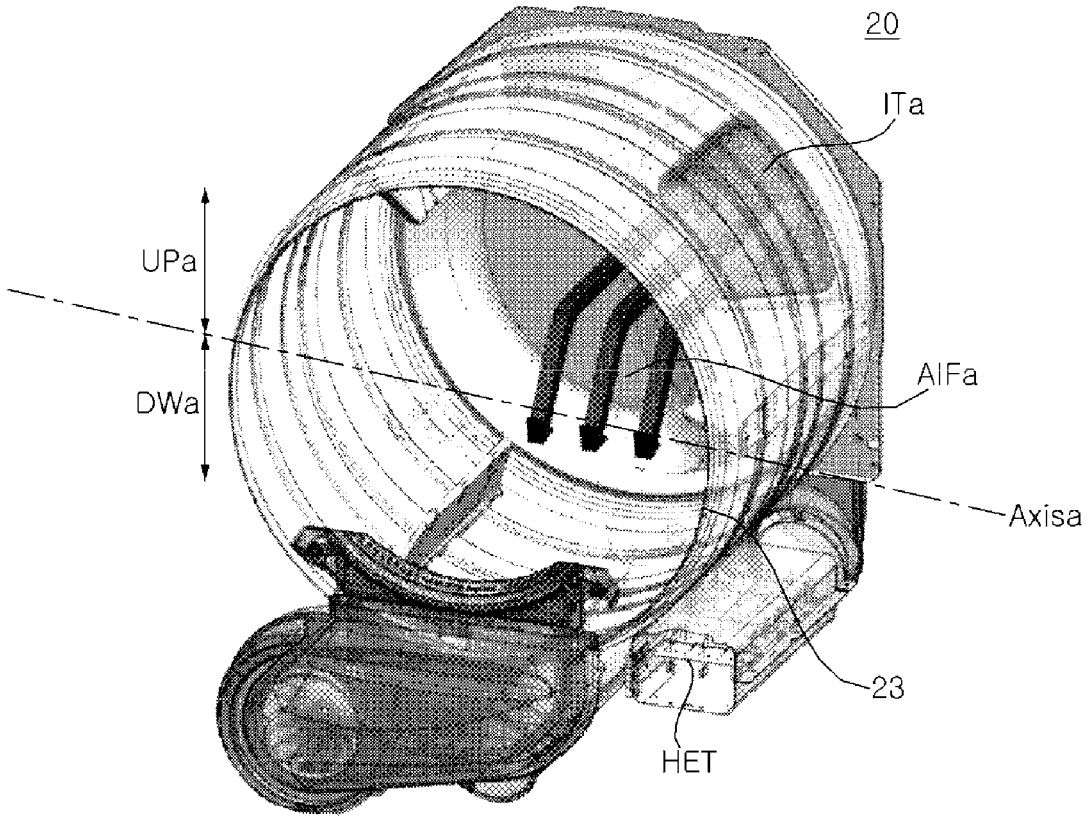
FIG. 1D is a view illustrating another example of a conventional dryer.

FIG. 1D is a view illustrating another example of a conventional dryer.

Referring to FIG. 1D, the conventional dryer 20 may include a cylindrical drum 23, an air intake Ita disposed on a rear surface of the drum 13, and a heater HET formed on the outside of the drum 13.

Air of which temperature is increased by the heater HET is supplied to the inside of the drum 23 through the air intake Ita, and thus, drying of the laundry inside the drum 23 is performed.

Meanwhile, according to this structure, the position of the air intake port Ita is higher than the bottom surface of the drum 23, and thus the laundry disposed on a bottom surface of the drum 23 cannot satisfactorily dried by the heated air supplied through the rear surface of the drum 23. Accordingly, there is a problem in that drying efficiency is lowered and a total drying time increases.

In the present disclosure, as illustrated in FIGS. 1A to 1D, a method for solving the problem of increasing the total drying time is proposed.

In particular, the present disclosure provides a method of performing uniform heating using the RF signal rather than local heating of the laundry inside the drum.

In addition, the present disclosure provides a method of implementing a drum shape simple in manufacturing when the laundry inside the drum is dried using the RF signal.

Figure 2:
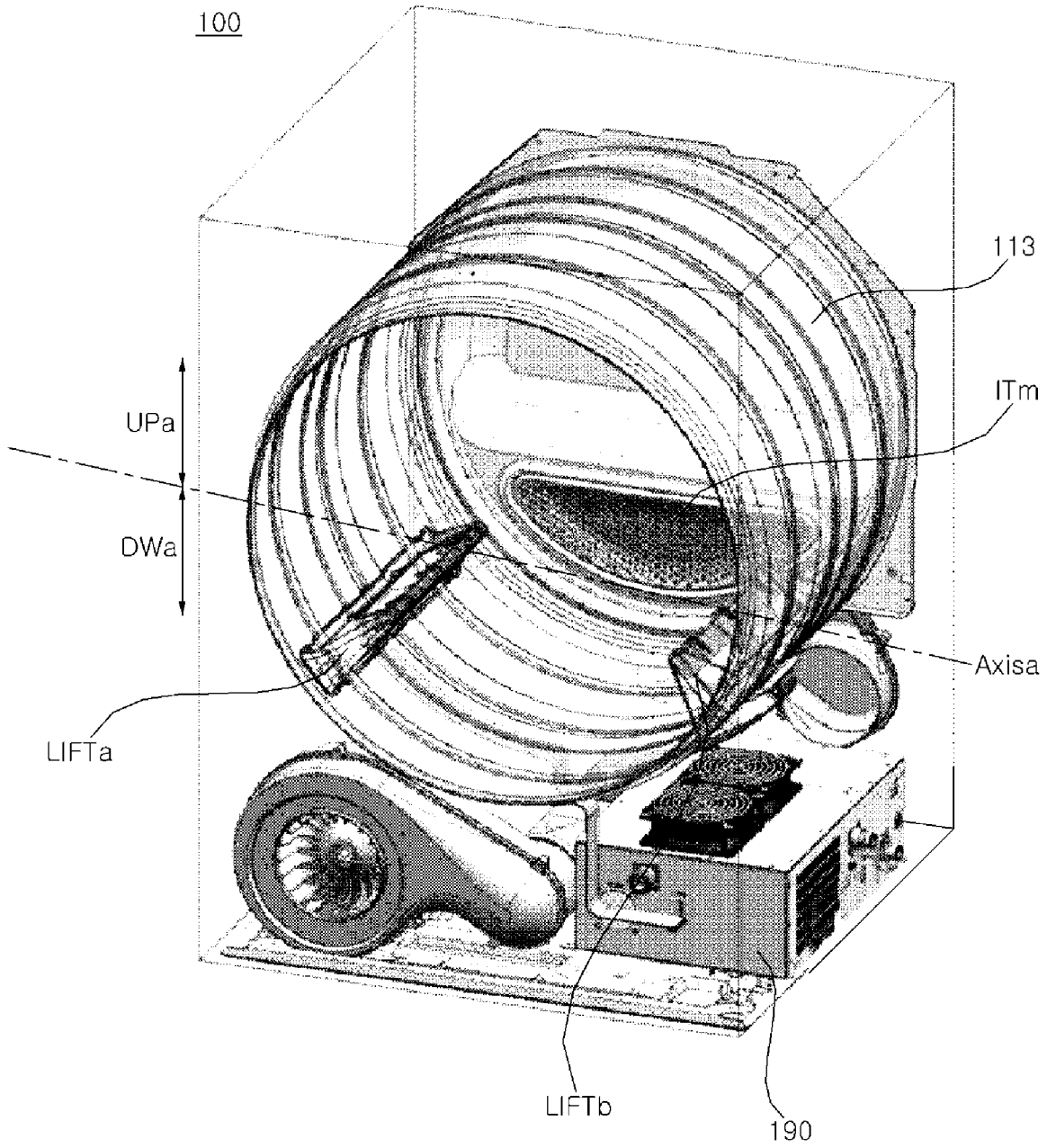
FIG. 2 is a perspective view illustrating a dryer according to an embodiment of the present disclosure.

FIG. 2 is a perspective view illustrating a dryer according to an embodiment of the present disclosure.

Referring to drawings, a dryer 100 according to an embodiment of the present disclosure includes a drum 113, at least one lifter LIFTa and LIFTb protruding from the inner peripheral surface of the drum 113, anodes AND which are disposed in the lifters LIFTa and LIFTb and output the RF signal, and an RF output device 190 for outputting an RF signal.

Accordingly, it is possible to uniformly dry the laundry in the drum 113 using the RF signal. In particular, since the inside of the drum 113 does not need to be recessed to form the lifters LIFTa and LIFTb, curved, laundry disposed between the lifters LIFTa and LIFTb can be uniformly dried.

The drum 113 may be formed of a metal member to serve as a cathode. For example, the drum 113 may include a hot-dip aluminum plated steel sheet (Alcosta), aluminum, or stainless steel. Accordingly, it is possible to have optimum electrical conductivity.

Meanwhile, at least one lifter LIFTa and LIFTb may be formed in the drum 113.

Although two lifters LIFTa and LIFTb are formed in the drum 113 in the drawings, two or more lifters may be formed.

Meanwhile, the lifters LIFTa and LIFTb are preferably formed of a plastic material rather than a metal material of the drum 113 in order to prevent parasitic capacitance and arcing while operating to output the RF signal.

It is preferable that the laundry LAD is disposed between the lifters LIFTa and LIFTb in the drum 113.

The RF output device 190 which is spaced from the drum 113 and outputs the RF signal may be disposed at the lower right of the drum 113.

Meanwhile, the RF signal from the RF output device 190 may be output into the drum 113 through the anodes ANDa and ANDb formed in the lifters LIFTa and LIFTb.

In addition to the laundry drying by the RF signal from the RF output device 190, it is preferable that the drying is performed by a separate air blowing.

For this, it is preferable that an air inlet ITm is formed in a portion of the drum 113.

In the drawings, it is exemplified that the air inlet ITm is formed in a lower region DWa of a rear surface of the drum 113.

Specifically, in order to dry the laundry LAD disposed between the first lifter LIFTa and the second lifter LIFTb, when the rear surface of the drum 113 of the cylindrical shape is based on a horizontal axis Axia, it is preferable that the air inlet ITm is formed in the lower region DWa of the rear surface of the drum 113 which is a region below the horizontal axis Axia.

FIGS. 3A to 3D are views referenced in the description of the lifter of FIG. 2.

Figure 3A:
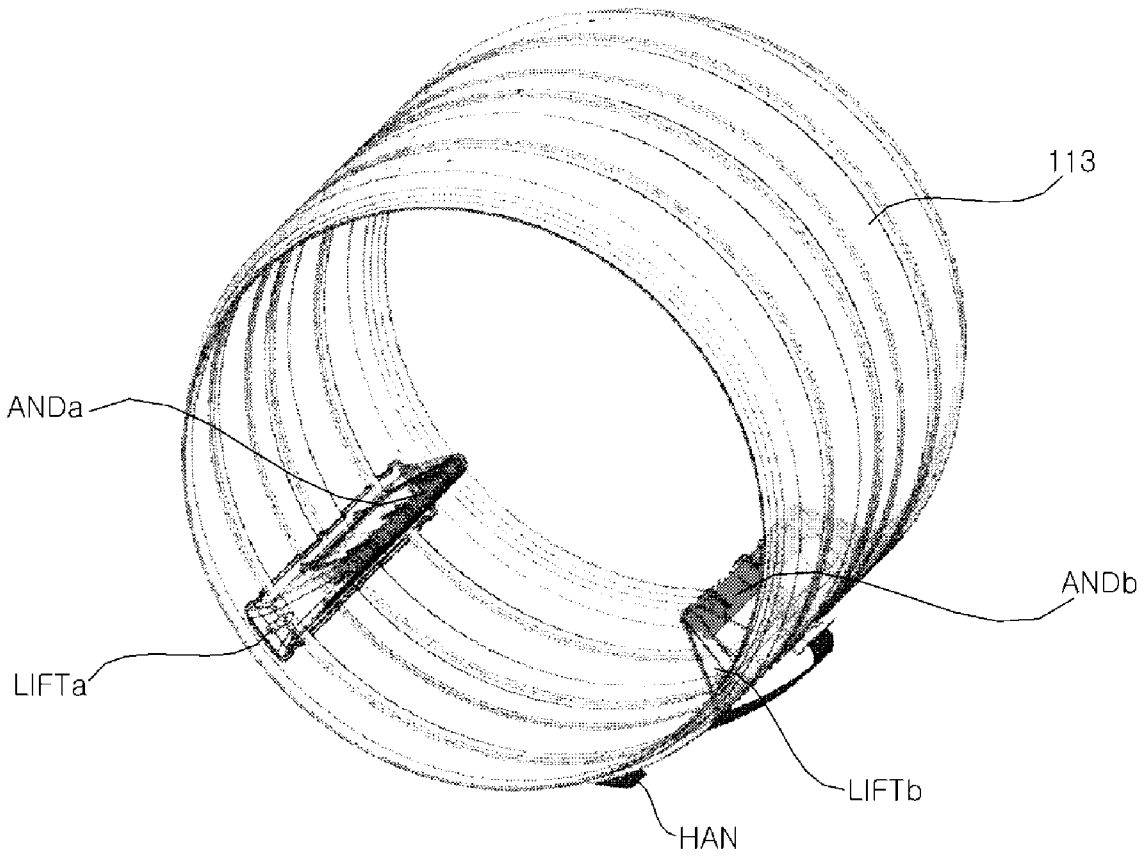
FIGS. 3A to 3D are views referenced in the description of the lifter of FIG. 2.

First, FIG. 3A illustrates the two lifters LIFTa and LIFTb protruding from the inner peripheral surface of the drum 113.

Figure 3B:
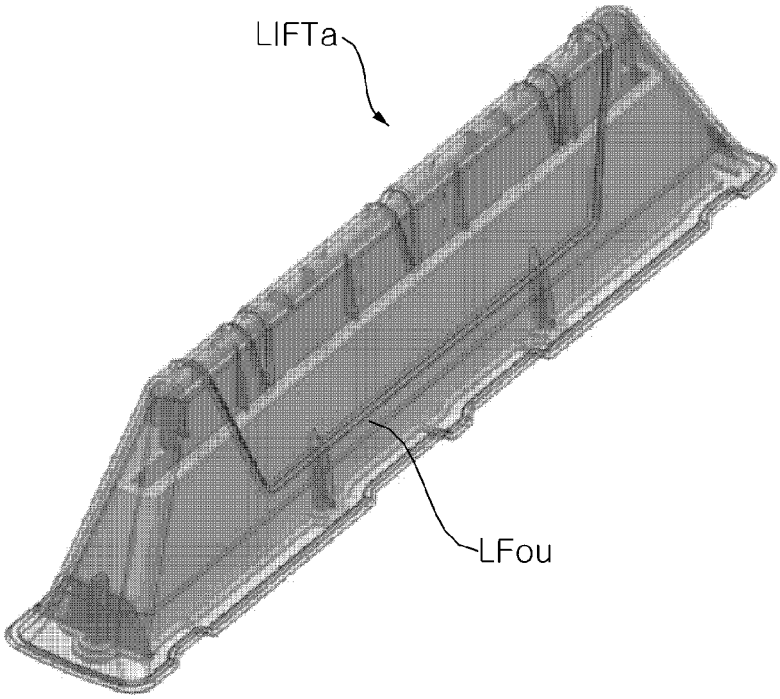
Figure 3C:
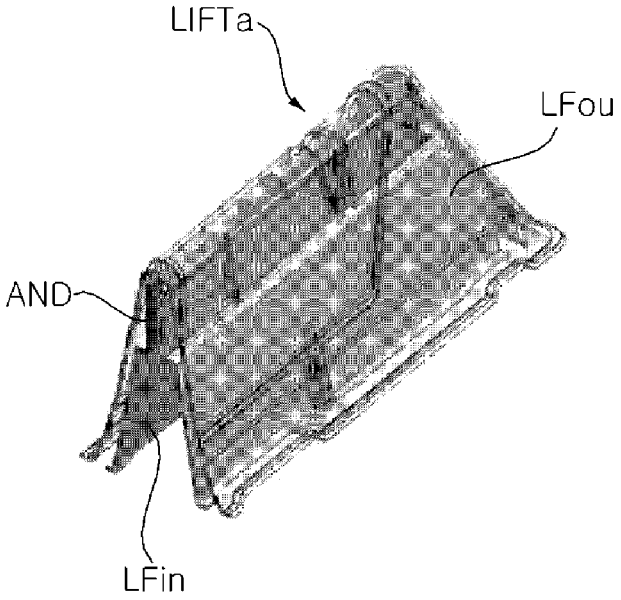

Referring to FIGS. 3B and 3C, each of the lifters LIFTa and LIFTb may include a lifter inner LFin and a lifter outer LFou. Then, the anode AND is disposed between the lifter inner LFin and the lifters LIFTa and LIFTb. Accordingly, it is possible to stably insulate the anode AND and the drum 113. In addition, it is possible to reduce arc generation.

Meanwhile, the first lifter LIFTa and the second lifter LIFTb are disposed to be spaced apart from each other, and a first anode ANDa in the first lifter LIFTa and a second anode ANDb in the second lifter LIFTb are electrically connected to each other by a connection electrode HAN outside the drum 113. Therefore, it is possible to output the RF signal from the first anode ANDa and the second anode ANDb through the connection electrode HAN.

Figure 3D:
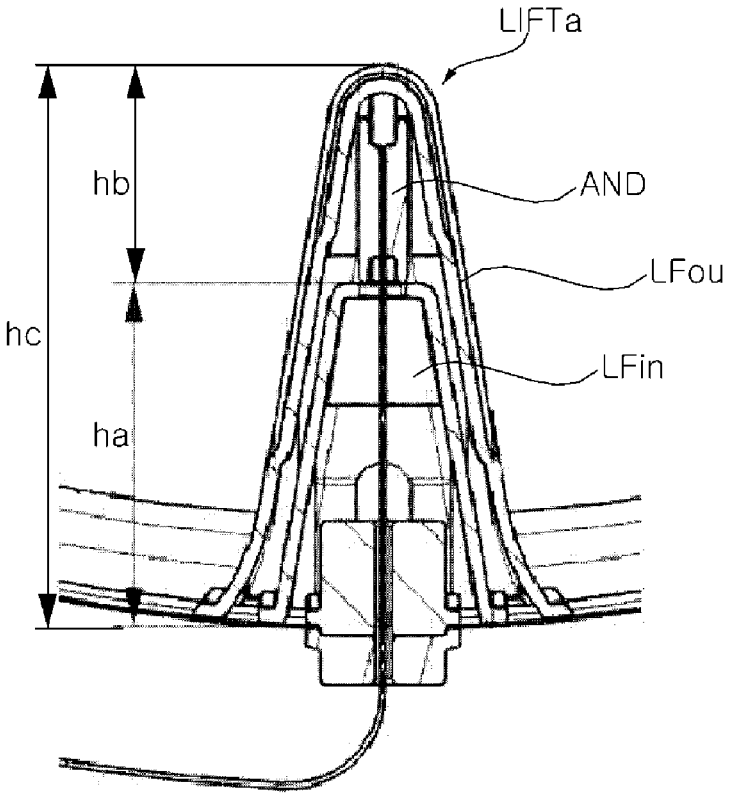

Meanwhile, as illustrated in FIG. 3D, a height of the lifter inner LFin is larger than a height of the anode AND. Accordingly, it is possible to protect the anode AND while protruding the anode AND. Moreover, it is possible to reduce the arc generation.

Meanwhile, the lifter inner LFin and the lifter outer LFou contain polypropylene PP. Accordingly, it is possible to reduce the efficiency loss due to parasitic capacitance.

Figure 4A:
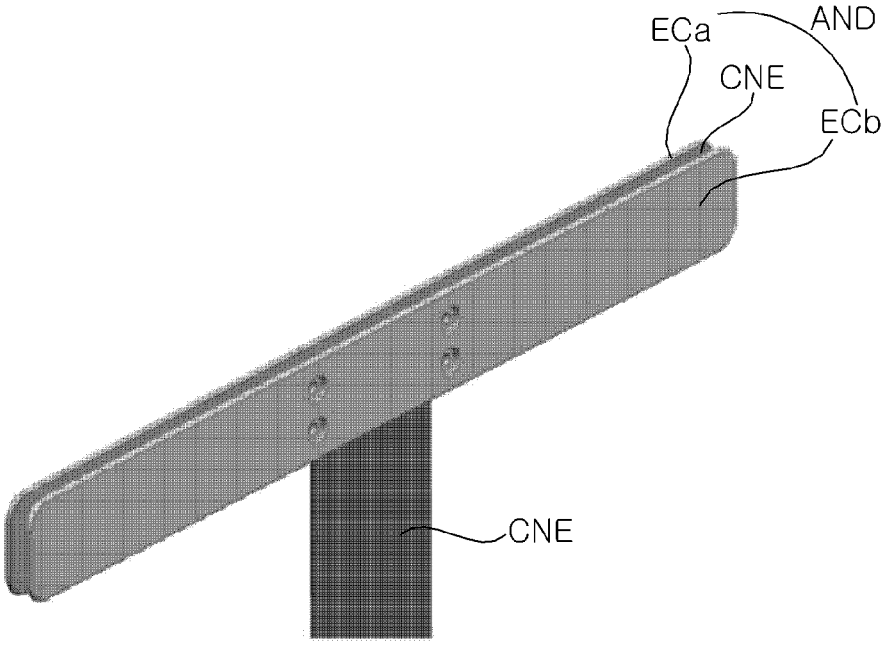
FIGS. 4A to 4C are views referenced in the description of an anode in the lifter.
Figure 4B:
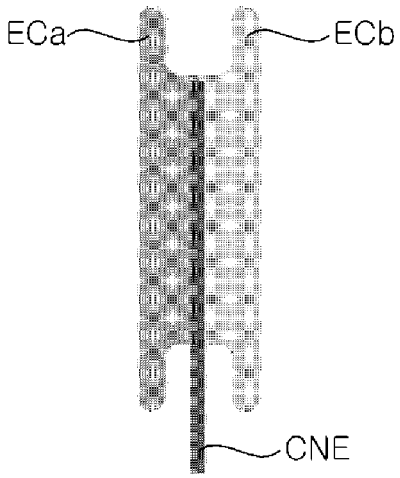
Figure 4C:
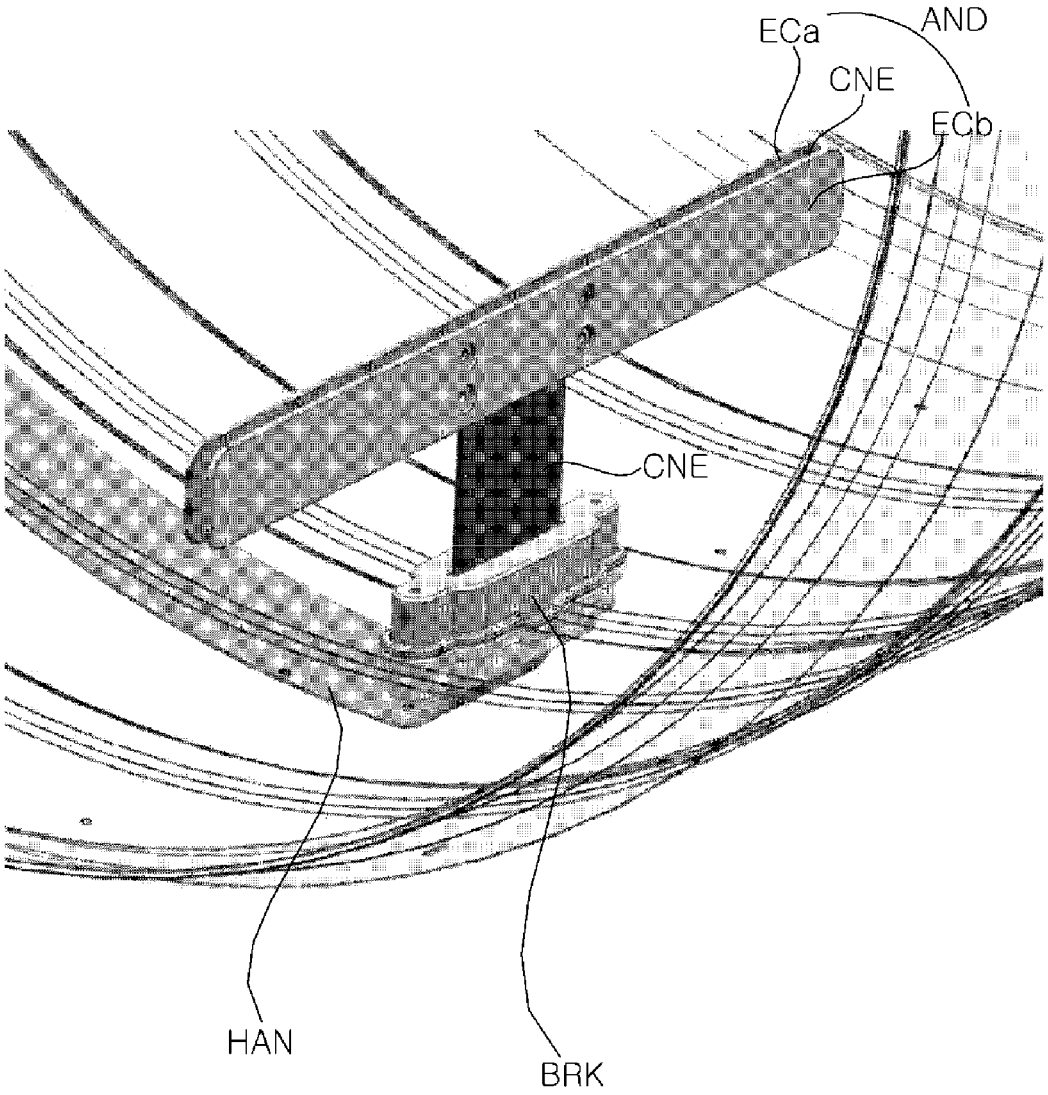

FIGS. 4A-4C are views referenced in the description of the anode in the lifter.

First, referring to FIGS. 4A and 4B, the anode AND includes a first electrode ECa and a second electrode ECb spaced apart from each other, and a third electrode CN3 connected between the first electrode ECa and the second electrode ECb. Accordingly, it is possible to simply connect the third electrode CNE and the connection electrode HAN.

Meanwhile, it is preferable that the third electrode CNE is made of copper to maximize electrical conductivity and transmit RF power to the first electrode ECa and the second electrode ECb.

Preferably, sizes or lengths of the first electrode ECa and the second electrode ECb are the same in order to maintain a balanced RF input and prevent inefficiency due to parasitic capacitance.

FIG. 4C is a view illustrating a bracket BRK connecting the third electrode CNE and the connection electrode HAN outside the drum 113.

Referring to the drawings, the bracket BRK may be disposed to connect the third electrode CNE and the connection electrode HAN outside the drum 113. The bracket BRK may be formed of a plastic material.

Specifically, the bracket BRK includes polytetrafluoroethylene. Accordingly, it is possible to reduce the RF parasitic capacitance and arc generation.

Meanwhile, in order to maintain a balanced RF input to the first anode ANDa and the second anode ANDb and to prevent inefficiency due to parasitic capacitance, it is preferably that the connection electrodes HAN have the same size or length.

Meanwhile, preferably, the width of the connection electrode HAN is about 40 to 60 mm for energy transfer efficiency.

Figure 5:
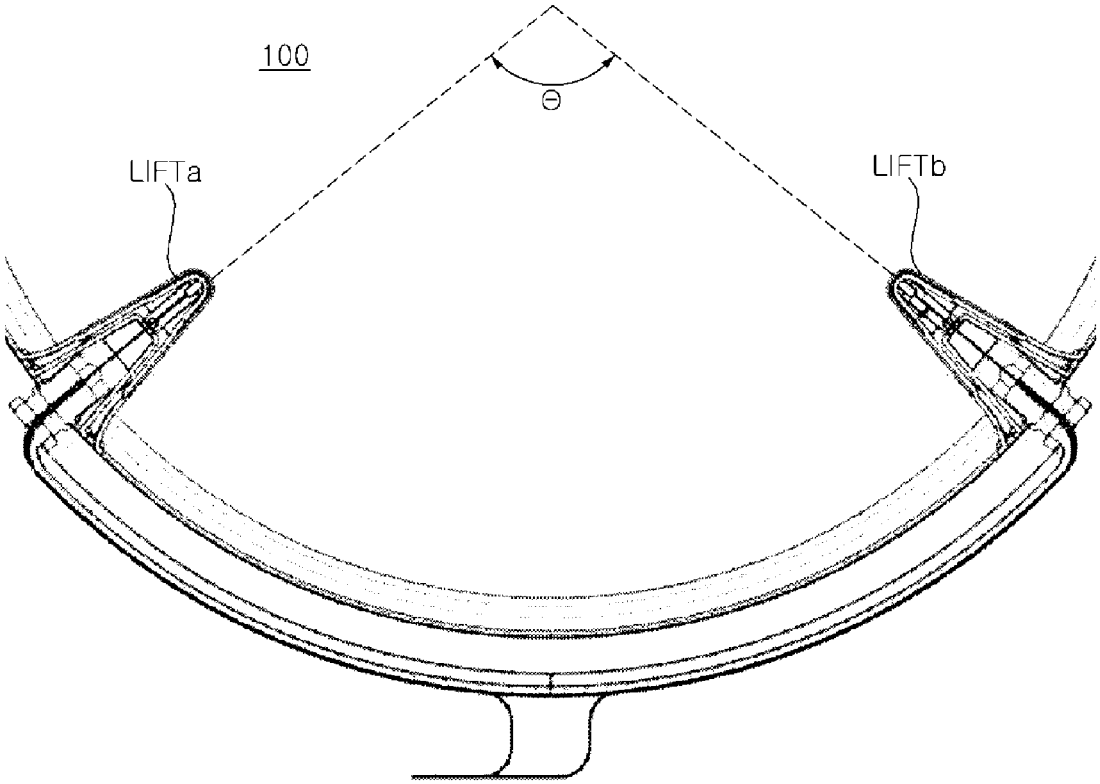
FIG. 5 is a view referenced in describing an angle between a first lifter and a second lifter.

FIG. 5 is a view referenced in describing the angle between the first lifter and the second lifter.

Referring to the drawings, in order to dry the laundry by the RF signal output from an end of the first lifter LIFTa and an end of the second lifter LIFTb, it is preferable that extension lines of the end of the first lifter LIFTa and the end of the second lifter LIFTb intersect each other.

In particular, it is preferable that the angle between the end of the first lifter LIFTa and the extension line of the end of the second lifter LIFTb is 90□ to 110□. In particular, it is most preferred that the angle is approximately 100□.

Accordingly, it is possible to perform heating and drying with maximum efficiency for the laundry between the first lifter LIFTa and the second lifter LIFTb.

Meanwhile, the anode AND includes aluminum. Accordingly, it is possible to improve the electrical conductivity of the anode AND.

Figure 6A:
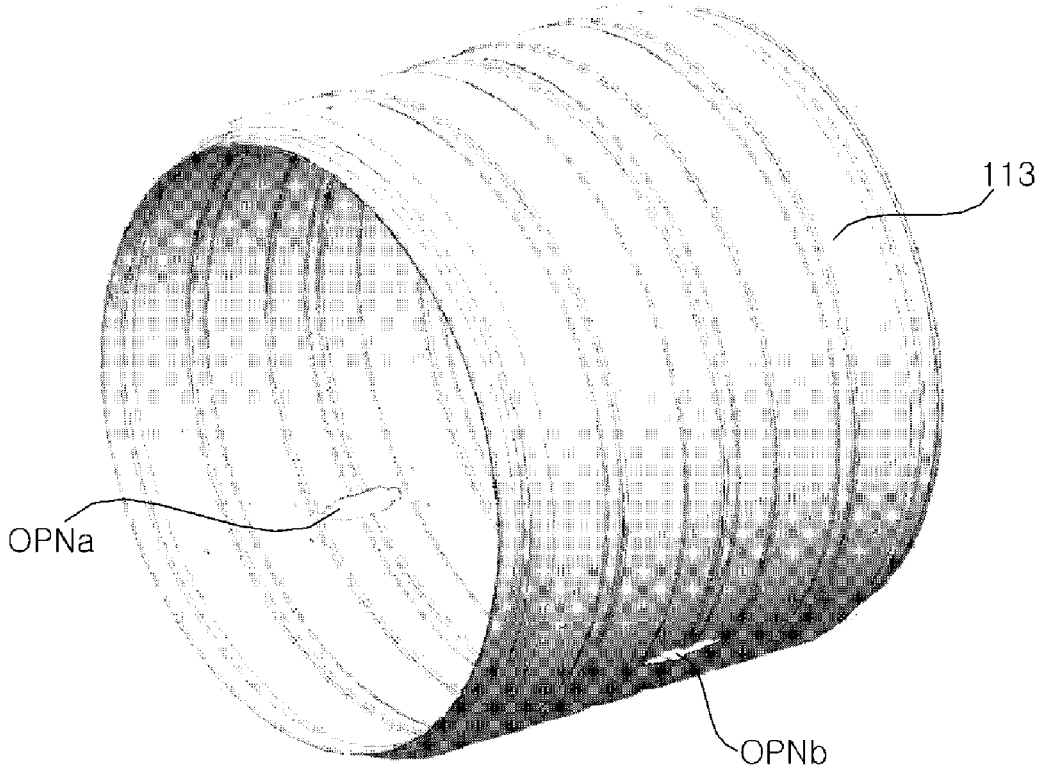
FIGS. 6A to 6C are views illustrating a process of forming the first lifter and the second lifter of FIG. 2.
Figure 6B:
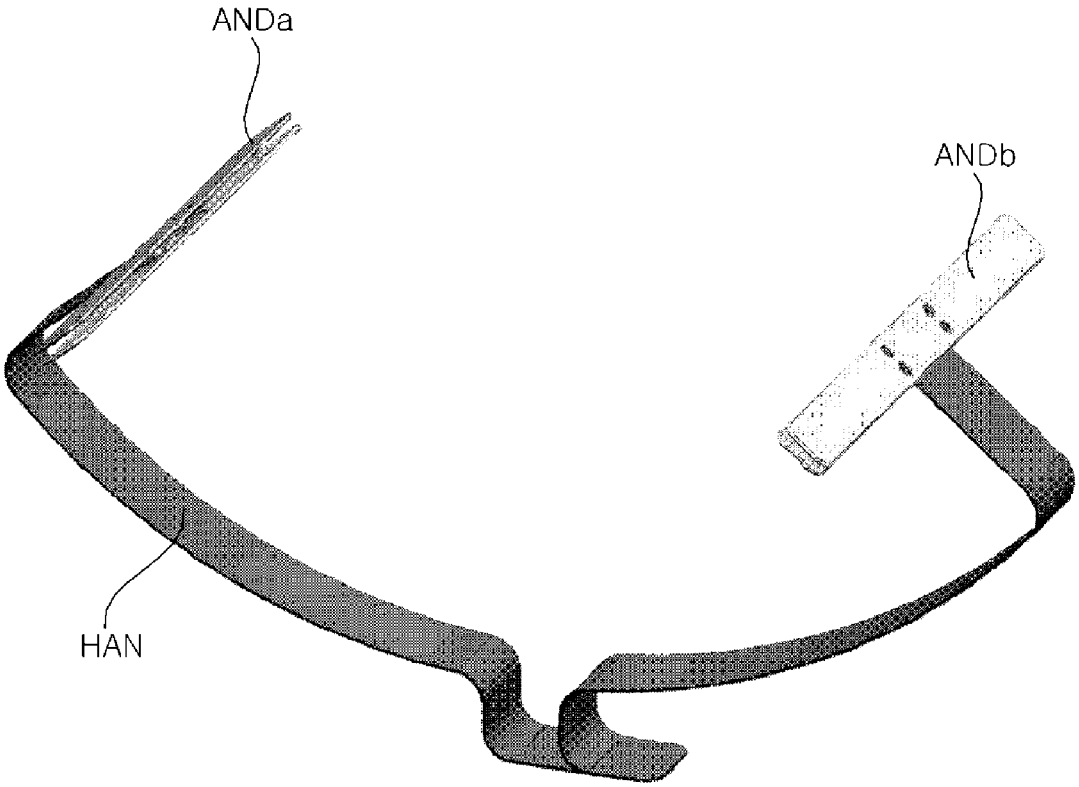
Figure 6C:
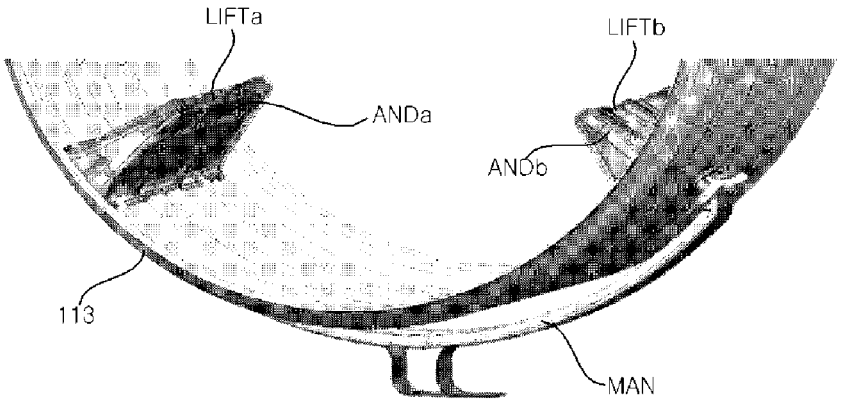

FIGS. 6A to 6C are views illustrating a process of forming the first lifter and the second lifter of FIG. 2.

First, referring to FIG. 6A, a first opening OPNa and a second opening OPNb may be formed in the drum 113.

Positions of the first opening OPNa and the second opening OPNb may correspond to positions of the first lifter LIFTa and the second lifter LIFTb.

Next, FIG. 6B illustrates the first anode ANDa and the second anode ANDb connected to the connection electrode HAN.

Meanwhile, as illustrated in FIG. 6C, the first lifter LIFTa is coupled and protruded through the first opening OPNa, and the second lifter LIFTb is coupled and protruded through the second opening OPNb. Accordingly, the first lifter LIFTa and the second lifter LIFTb are stably disposed.

In particular, since the inside of the drum 1130 is not required to be curved to form the lifter, uniform drying of the laundry LAD disposed between the lifters LIFTa and LIFTb is possible.

Figure 7:
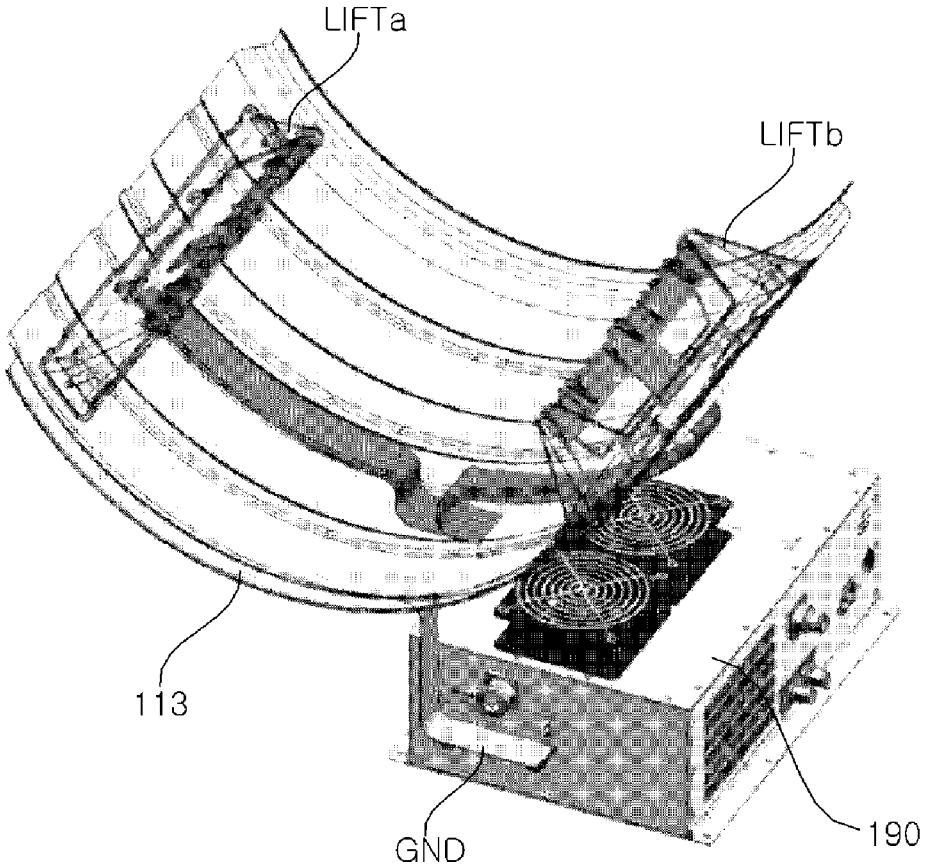
FIG. 7 is a view illustrating a ground electrode connected to a drum.

FIG. 7 is a view illustrating a ground electrode connected to the drum.

Referring to the drawings, a ground electrode GND may be connected to the outer peripheral surface of the drum 113. Accordingly, a ground connection to the drum 113 acting as a cathode is possible.

In particular, the ground electrode GND may be connected between the outer peripheral surface of the drum 113 and the RF output device 190 disposed on the lower right side of the drum 113.

Accordingly, the ground connection to the drum 113 serving as a cathode is possible through the RF output device 190.

Figure 8A:
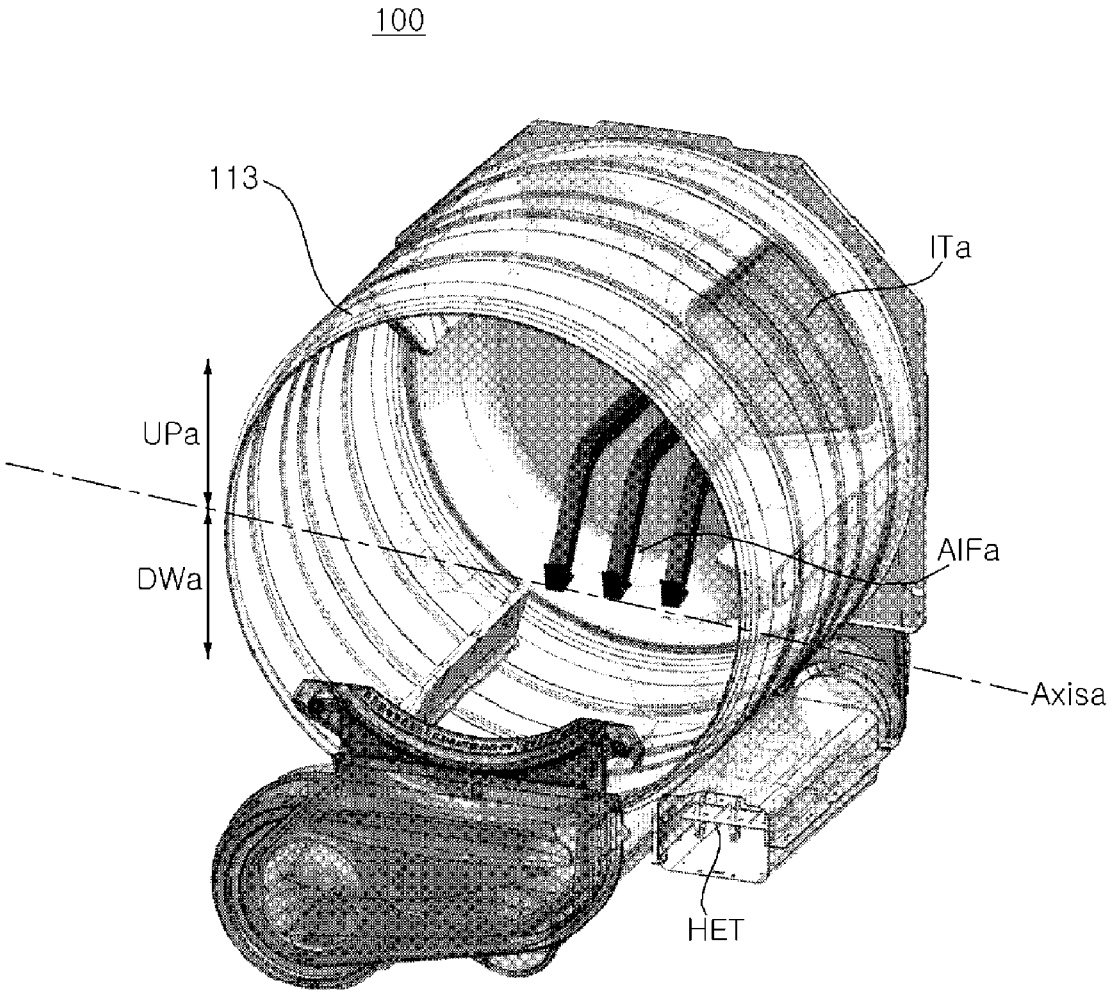
FIG. 8A is a view illustrating an air flow of a conventional dryer.

FIG. 8A is a view illustrating an air flow of the conventional dryer.

Referring to the drawings, it is exemplified that the air inlet ITa is formed in the upper region UPa of the rear surface of the drum 113 in the conventional dryer 20.

Therefore, in order to dry laundry disposed on the lower portion of the drum 23, as indicated by AIFA, the air flow path should be refracted not in a straight direction. Accordingly, the drying performance in the dryer 20 of FIG. 8A is reduced, and there is a disadvantage that the drying time is long.

In the present disclosure, in order to solve this problem, it is assumed that the position of the air inlet is moved to the lower region of the drum.

Figure 8B:
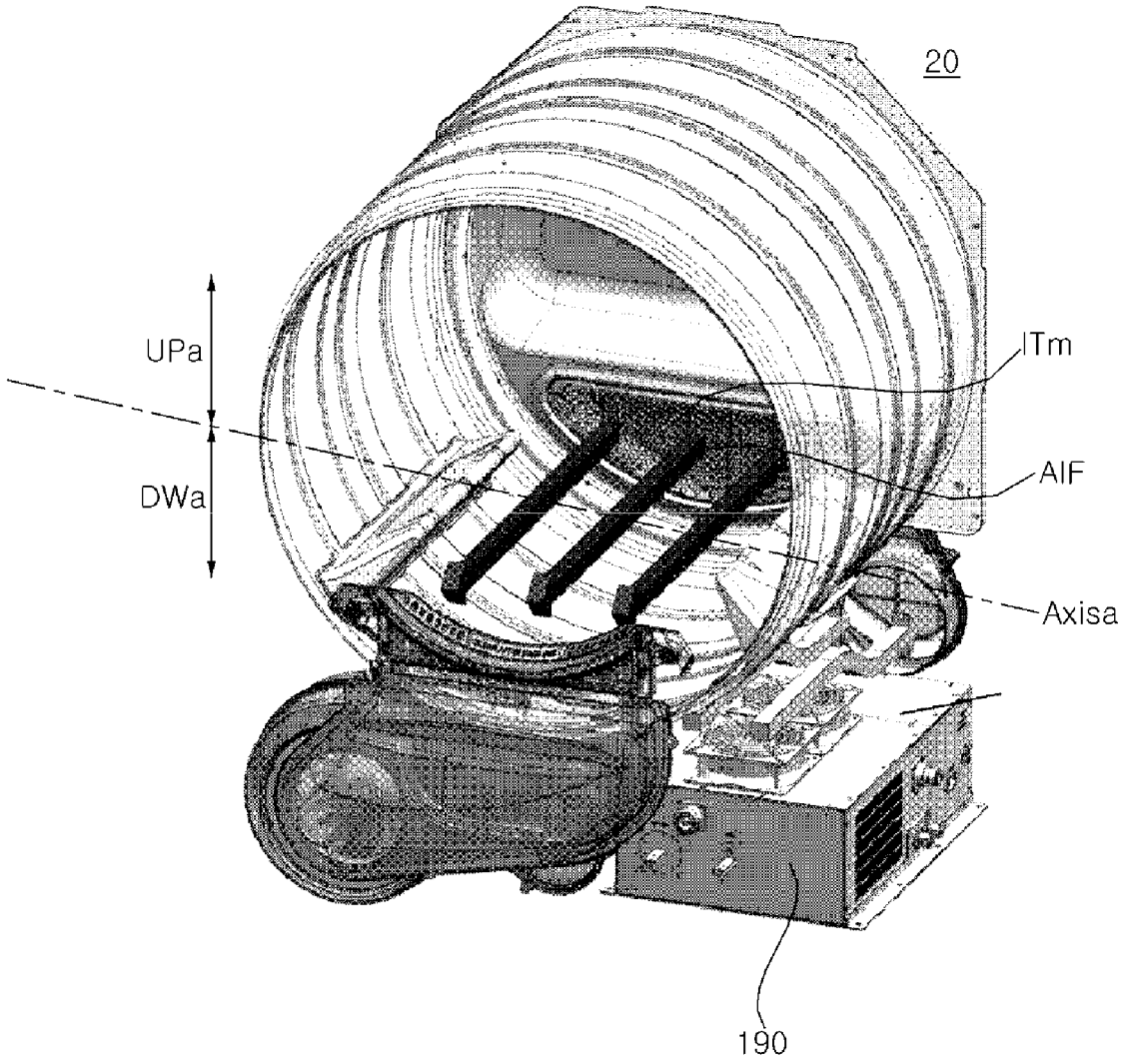
FIG. 8B is a view illustrating an air flow of the dryer according to the embodiment of the present disclosure.

FIG. 8B is a view illustrating an air flow of the dryer according to the embodiment of the present disclosure.

In the drawings, it is exemplified that the air inlet ITm is formed in the lower region DWa of the rear surface of the drum 113.

Specifically, in order to dry the laundry LAD disposed between the first lifter LIFTa and the second lifter LIFTb, when the rear surface of the drum 113 having the cylindrical shape is based on the horizontal axis Axia, it is preferable that the air inlet ITm is formed in the lower region DWa of the rear surface of the drum 113 which is a region below the horizontal axis Axia.

Accordingly, as indicated by AIF, the air flow path through the air inlet ITm is formed in the straight direction, and thus, the drying of the laundry (LAD) disposed between the first lifter LIFTa and the second lifter LIFTb is will be performed smoothly. Therefore, compared to FIG. 8A, the drying efficiency is improved, and the drying time is shortened.

In addition, by using the RF signal rather than the heater method of FIG. 8A, it is possible to perform drying quickly while reducing damage to the laundry LAD. Moreover, it is possible to stably perform drying while preventing arc by the first lifter LIFTa and the second lifter LIFTb.

Figure 9:
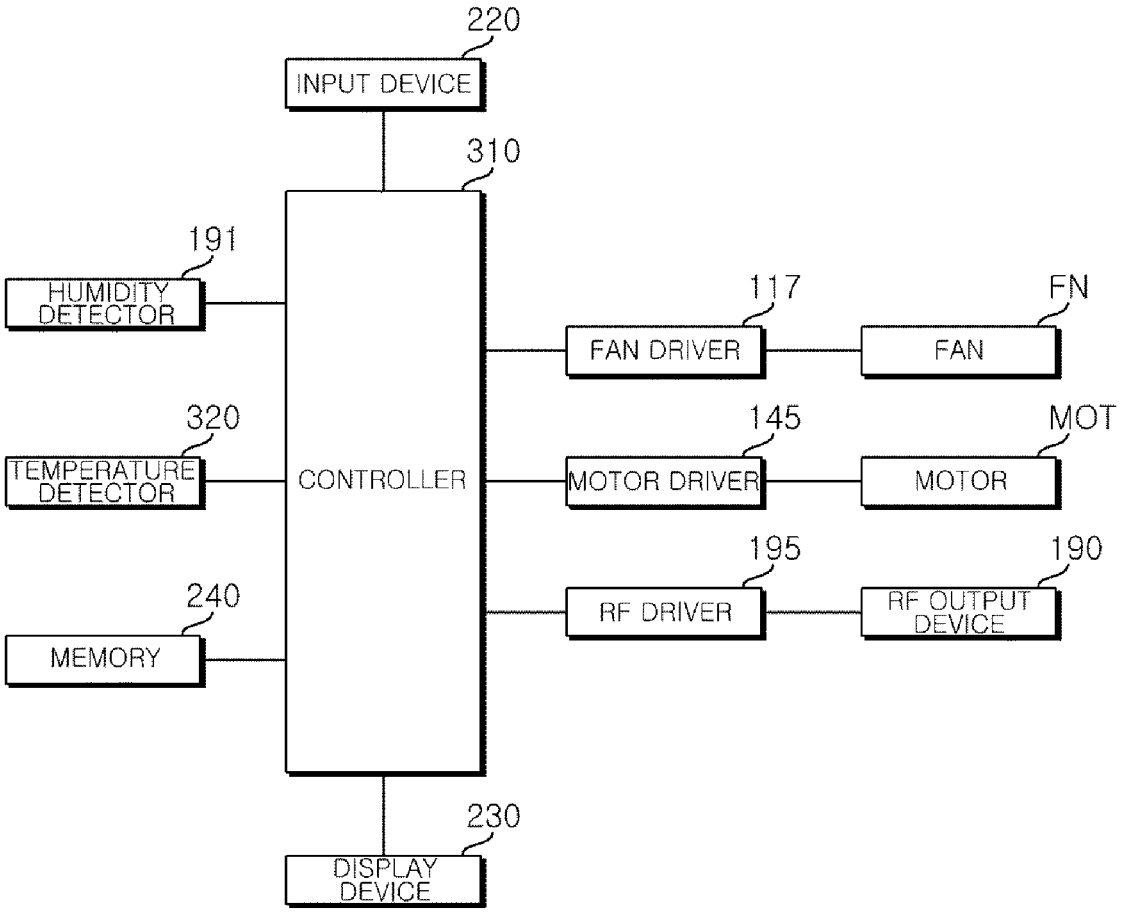
FIG. 9 is a block diagram schematically illustrating the inside of the dryer illustrated in FIG. 2.

FIG. 9 is a block diagram schematically illustrating the inside of the dryer illustrated in FIG. 2.

Referring to the drawings, the dryer of FIG. 9 is a compressor 112, a fan FN, a motor MOT, a controller 310, the RF output device 190, a humidity detector 191, a temperature detector 320, and a memory 240.

In addition, the dryer may further include a compressor driver 113, a fan driver 117, a motor driver 145, an RF driver 195, a display device 230, and an input device 220.

The input device 220 is provided with a plurality of operation buttons and transmits a signal for an input drying setting time or the like to the controller 310.

The display device 230 may display the operating state of the dryer. Meanwhile, the display device 230 is operable under the control of a display controller (not illustrated).

The memory 240 may store data necessary for a dryer operation.

The temperature detector 320 senses the temperature in the dryer and transmits a signal for the sensed temperature to the controller 310.

The humidity sensor 191 senses the humidity in the dryer and transmits a signal for the sensed humidity to the controller 310.

As illustrated in the drawings, in order to control on/off operations of the fan FN, the motor MOT, and the RF output device 190, the controller 310 may control the fan driver 117, the motor driver 145, the RF driver 195.

Meanwhile, the fan driver 117 may include a fan motor (not illustrated), and the fan motor (not illustrated) may be operated at a target rotation speed under the control of the controller 310.

The motor driver 145 includes a motor MOT, and the motor MOT may be operated at a target rotation speed and a target rotation direction under the control of the controller 310. Accordingly, the drum 113 may be rotated by the rotation of the motor MOT.

When the motor is a three-phase motor, the motor may be controlled by a switching operation in an inverter (not illustrated) or may be controlled at a constant speed using an AC power source as it is. Here, each motor (not illustrated) may be any one of an induction motor, a blush less DC (BLDC) motor, or a synchronous reluctance motor (synRM) motor.

Meanwhile, as described above, the controller 310 may control the overall operation of the dryer 100 in addition to controlling the operation of the fan driver 117, the motor driver 145, and the RF driver 195.

Figure 10:
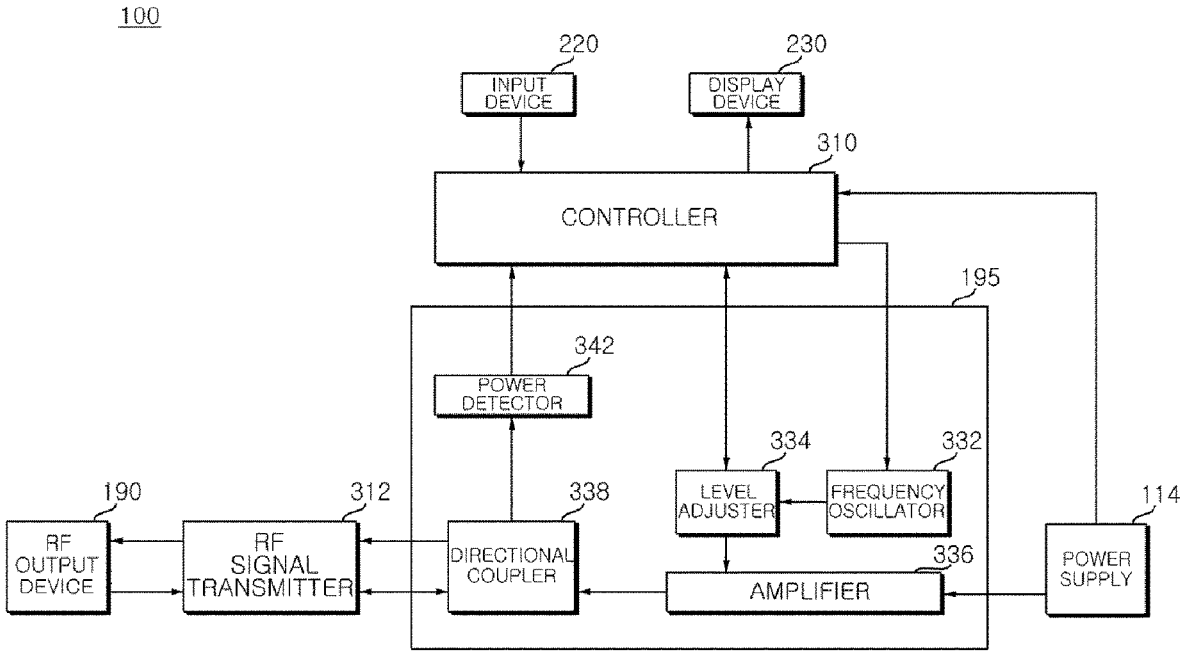
FIG. 10 is a diagram illustrating a block diagram of an inside of an RF driver of FIG. 9.

FIG. 10 is a diagram illustrating a block diagram of the inside of the RF driver of FIG. 9.

Referring to the drawing, the RF output device 190 may be connected to the RF signal transmitter 312, and the RF signal transmitter 312 may be connected to the RF driver 195.

The input device 220 may include a separate button for operating on or off the RF output device 190.

The display device 230 may display information related to the operating on or off of the RF output device 190.

The controller 310 may control the RF output device 190 by using the RF driver 195.

The RF driver 195 may include a frequency oscillator 332, a level adjuster 334, an amplifier 336, a directional coupler 338, and a power detector 342.

The frequency oscillating unit 332 oscillates to output an RF signal of a corresponding frequency, by a frequency control signal from the controller 310.

The frequency oscillator 322 may include a voltage controlled oscillator VCO. Based on the voltage level of the frequency control signal, the voltage controlled oscillator VCO oscillates a corresponding frequency. For example, as the voltage level of the frequency control signal becomes higher, the frequency oscillated and generated by the voltage controlled oscillator VCO becomes higher.

The level adjuster 334 may oscillate the frequency signal oscillated by the frequency oscillator 332 to output an RF signal with a corresponding power based on the power control signal. The level adjuster 334 may include a voltage controlled attenuator VCA.

Based on the voltage level of the power control signal, the voltage controlled attenuator VCA performs a correction operation so that an RF signal is output with a corresponding power. For example, as the voltage level of the power control signal becomes higher, the power level of the signal output from the voltage controlled attenuator VCA becomes higher.

The amplifier 336 may output a RF signal by amplifying the oscillated frequency signal, based on the frequency signal oscillated by the frequency oscillator 332 and the power control signal by the level adjuster 334.

As described above, the amplifier 336 may include a solid state power amplifier SSPA using a semiconductor device, and in particular, may include a Monolithic Microwave Integrated Circuits MMIC using a single substrate. Thus, the size thereof is reduced, and the integration of device can be achieved.

Meanwhile, the frequency oscillator 332, the level adjuster 334, and the amplifier 336, described above, may be implemented as a single unit, which may be referred to as a solid state power oscillator SSPO.

The directional coupler DC 338 transmits the RF signal amplified and output by the amplifier 336 to the RF signal transmitter 312. The RF signal output from the RF signal transmitter 312 is output to the laundry in the RF output device 190.

Meanwhile, the RF signal that is not absorbed and reflected by the laundry in the RF output device 190 may be input to the directional coupler 338 through the RF signal transmitter 312. The directional coupler 338 transfers the reflected RF signal to the controller 310.

Meanwhile, the power detector 342 is disposed between the directional coupler 338 and the controller 310, and detects the output power of the RF signal which is amplified and output by the amplifier 336 and transferred to the RF signal transmitter 312 via the directional coupler 338. The detected power signal is input to the controller 310, and is used for a signal output efficiency calculation. Meanwhile, the power detector 342 may be implemented of a diode device, or the like to detect a power.

Meanwhile, the power detector 342 is disposed between the directional coupler 338 and the controller 310, and detects the power of the reflected RF signal reflected by the RF output device 190 and received by the directional coupler 338. The detected power signal is input to the controller 310, and is used for signal output efficiency calculation. Meanwhile, the power detector 342 may be implemented of a diode device, or the like to detect a power.

Meanwhile, the RF driver 195 is disposed between the amplifier 336 and the directional coupler 338, and may further include an isolation unit (not illustrated) for passing through the RF signal in the case of transferring the RF signal amplified by the amplifier 336 to the RF output device 190, and blocking the RF signal reflected from the RF output device 190. Here, the isolation unit (not illustrated) may be implemented of an isolator.

The controller 310 may calculate signal output efficiency, based on the RF signal which is not absorbed and reflected by the laundry among the RF signals emitted into the RF output device 190.

Meanwhile, when the plurality of RF signals are sequentially emitted into the RF output device 190, the controller 310 calculates signal output efficiency for each frequency of the plurality of RF signals.

Meanwhile, the controller 310 may control a RF signal output section to be divided into a scan section and a main operation section so as to output signal efficiently.

The controller 310 may sequentially output a plurality of RF signals into the RF output device 190 during the scan section, and calculate signal output efficiency based on the reflected RF signal.

In addition, the controller 310 may output RF signals having different output periods respectively or output only the RF signal having a certain frequency, in the main operation section, based on the signal output efficiency calculated in the scan section. Meanwhile, it is preferable that the power of the RF signal in the main operation section is significantly higher than the power of the RF signal in the scan section. Thus, power consumption can be reduced.

The controller 310 may generate and output a frequency control signal to vary the output period of the RF signal based on the calculated signal output efficiency.

Meanwhile, the controller 310 may control to output the RF signal of corresponding frequency, only when the signal output efficiency calculated for each frequency is equal to or greater than a set value.

The power supply 114 may boost the power input to the dryer 100 to a high voltage and output to the RF driver 195. The power supply 114 may be implemented of a high voltage transformer or an inverter.

Figure 11:
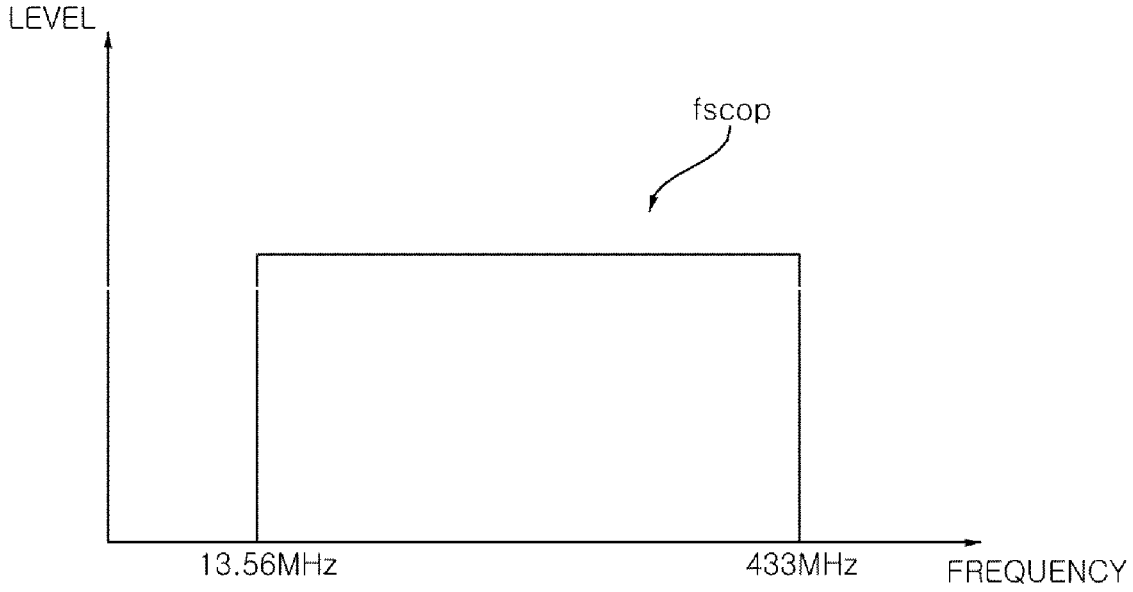
FIG. 11 illustrates a range of frequencies output from an RF output device.

FIG. 11 illustrates a range of frequency output from the RF output device 190.

Referring to the drawing, it is preferable that the frequency range fscop of the RF signal is between 13.56 MHz and 433 MHz.

For example, when the frequency of the RF signal is less than 13.56 MHz, the movement of water molecules in the laundry is not performed smoothly, and thus, the drying operation is not performed smoothly. Moreover, when the frequency is more than 433 MHz, the movement of water molecules in the laundry is too actively performed, and thus, the temperature of the laundry may increase.

Therefore, in the present disclosure, the frequency fscop of the RF signal used in the RF output device 190 ranges from 13.56 MHz to 433 MHz.

Meanwhile, as described above, depending on the type or amount of the laundry, the frequency of the RF signal may change within 13.56 MHz to 433 MHz.

For example, the controller 310 may increase the frequency of the RF signal as the amount of laundry increases. Accordingly, the movement of water molecules in the laundry LAD by the RF signal becomes active, and thus, the drying of the laundry LAD can be performed smoothly.

In the dryer according to the present disclosure, the configuration and method of the embodiments described above are not limitedly applicable, but the embodiments are configured by selectively combining all embodiments or some embodiments so that various modifications can be made.

In addition, although preferred embodiments of the present disclosure have been illustrated and described above, the present disclosure is not limited to the specific embodiments described above, various modifications can be made by those with ordinary skill in the technical field to which the invention belongs without departing from the gist of the present disclosure in claims, and the modifications should not be understood individually from the technical spirit or perspective of the present disclosure.

The present disclosure is applicable to a dryer, and more specifically, to a dryer that can dry laundry uniformly using an RF signal.

What is claimed is:

1. A dryer comprising:

a drum;

at least one lifter that protrudes from an inner peripheral surface of the drum; and an anode disposed in the lifter and configured to output a radio frequency (RF) signal into the drum.

2. The dryer of claim 1, wherein the lifter includes a lifter inner and a lifter outer, and the anode is disposed between the lifter inner and the lifter.

3. The dryer of claim 2, wherein a height of the lifter inner is larger than a height of the anode.

4. The dryer of claim 2, wherein the lifter inner and the lifter outer include polypropylene (PP).

5. The dryer of claim 1, wherein a first lifter and a second lifter are disposed to be spaced apart from each other, and a first anode in the first lifter and a second anode in the second lifter are electrically connected to each other by a connection electrode outside the drum.

6. The dryer of claim 5, wherein an angle between an end of the first lifter and an extension line of an end of the second lifter is 90 to 110.

7. The dryer of claim 5, wherein a first opening and a second opening are formed in the drum, the first lifter is coupled and protruded through the first opening, and the second lifter is coupled and protruded through the second opening.

8. The dryer of claim 1, wherein the anode includes a first electrode and a second electrode spaced apart from each other, and a third electrode connected between the first electrode and the second electrode.

9. The dryer of claim 8, further comprising a bracket configured to connect the third electrode and a connection electrode outside the drum to each other.

10. The dryer of claim 9, wherein the bracket includes polytetrafluoroethylene.

11. The dryer of claim 1, wherein the anode includes aluminum.

12. The dryer of claim 1, further comprising a ground electrode connected to an outer peripheral surface of the drum.

13. The dryer of claim 1, wherein an air inlet is formed in a lower region of the drum.

14. The dryer of claim 1, further comprising:

an RF driver configured to generate the RF signal, wherein the RF driver is configured to generate a first RF signal of first power during a scan section and to configured to generate a second RF signal of second power having a higher level than the first power during a heating section based on an RF signal reflected in response to the first RF signal of the first power during the scan section.

15. The dryer of claim 14, wherein the RF driver is configured to change the second power of the second RF signal based on the reflected RF signal during the scan section.

16. The dryer of claim 1, further comprising an RF driver configured to generate the RF signal.

17. The dryer of claim 16, wherein the RF driver comprises a frequency oscillator.

* * * * *